United States Patent [19]

Dykema

[11] 4,427,362

[45] Jan. 24, 1984

[54] COMBUSTION METHOD

[75] Inventor: Owen W. Dykema, Canoga Park, Calif.

[73] Assignee: Rockwell International Corporation, El Segundo, Calif.

[21] Appl. No.: 178,210

[22] Filed: Aug. 14, 1980

[51] Int. Cl.[3] ..... F23J 7/00

[52] U.S. Cl. ..... 431/4; 431/10; 431/352; 110/345

[58] Field of Search ..... 431/3, 4, 8, 9, 10, 431/12, 351, 352; 110/341, 342, 344, 345; 60/39.02

[56] References Cited

U.S. PATENT DOCUMENTS

| | | | |
|---|---|---|---|
| 1,970,109 | 8/1934 | Stratton | 110/266 |
| 2,800,172 | 7/1957 | Romer et al. | 431/3 |
| 3,746,498 | 7/1973 | Stengel | 431/10 |
| 3,837,303 | 9/1974 | Baardson | 431/352 |
| 4,050,877 | 9/1977 | Craig et al. | 431/10 |
| 4,130,388 | 12/1978 | Flanagan | 431/10 |
| 4,343,606 | 8/1982 | Blair et al. | 431/10 |

*Primary Examiner*—Carroll B. Dority, Jr.
*Attorney, Agent, or Firm*—Henry Kolin; Clark E. DeLarvin; H. Fredrick Hamann

[57] ABSTRACT

A method for substantially reducing emissions of nitrogenous compounds such as $NO_x$ formed during fuel combustion. The fuel is combusted with an oxygen-containing gas in an amount from about 45 to 75% of the total stoichiometric amount of oxygen required for complete combustion of the fuel. The resulting mixture of fuel and combustion products, including $NO_x$, is maintained at a temperature of at least 1800° K. for a time sufficient to reduce the $NO_x$ content of the mixture to a desired level. Thereafter, combustion may be completed in one or more additional zones at a temperature within the range of about 1600° to 2000° K. Alternatively, the mixture of combustion products and fuel having a reduced $NO_x$ content may be used for other applications without further combustion. For certain embodiments of the invention, various particulates may be added to the combustion zone so as to enhance the rate at which the $NO_x$ is destroyed.

17 Claims, 4 Drawing Figures

COMBUSTION METHOD

FIELD OF THE INVENTION

The present invention relates to the combustion of fuels so that minimal emission of oxides of nitrogen occurs. It particularly relates to the substantially complete combustion of carbonaceous and hydrocarbon fuels containing fuel-bound nitrogen so that substantially reduced $NO_x$ emission occurs.

BACKGROUND ART

Within the past few years there has been an increasing concern with the immediate and long-term problems resulting from the ever-increasing pollution of the atmosphere. With this concern has come an awareness at all levels that steps must be taken to halt the increasing pollution and, if at all possible, to reduce the present pollution levels. Accordingly, a substantial amount of effort and money is being spent by business and governmental agencies to develop standards and measures for preventing further significant discharge of pollutants into the atmosphere. Among the pollutants of concern are the various oxides of nitrogen ($NO_x$) present in the waste gases discharged from many metal refining and chemical plants, such as in nitric acid producing plants, and in the flue gases from power plants generating electricity by the combustion of fossil fuels. A predominant form of nitrogen oxide is nitric oxide (NO). This is a colorless gas which, upon release to the atmosphere, comes into contact with oxygen and can react therewith to form nitrogen dioxide ($NO_2$) or any of the numerous other oxides of nitrogen. Nitrogen dioxide is a yellow-brown gas known to be toxic to both plant and animal life.

Nitrogen oxides ($NO_x$) are formed during the combustion of carbonaceous or hydrocarbon fuels in one of two ways. Nitrogen oxides may be formed by a thermal mechanism occurring at elevated temperatures between the nitrogen and oxygen contained in the combustion air (thermal $NO_x$), or $NO_x$ may result from the oxidation of nitrogen compounds found in the fuel (so-called fuel-bound nitrogen). Heretofore, the principal effect has been directed toward avoiding the formation of thermally formed nitrogen oxide; and various methods are reported in the literature which attempt to inhibit or prevent such formation.

In U.S. Pat. No. 4,050,877, it is proposed to use temperature control to reduce the quantity of thermally formed nitrogen oxides. In accordance with the technique disclosed therein, fuel is burned in a primary combustion chamber with less than the amount of air required for complete combustion so that the formed combustion gases have a high carbon monoxide and hydrocarbon content and the temperature of these formed gases is held below that at which significant quantities of nitrogen oxides would be produced. The combustion gases are then passed through a secondary combustion zone in which more air is injected into the gas stream to oxidize the CO and hydrocarbons to carbon dioxide and water. The secondary burner comprises a plurality of foraminous tubes through which secondary air is emitted. Combustion in the secondary zone also is maintained at a temperature below that at which thermal $NO_x$ will be produced in significant quantities. Similar techniques for minimizing the amount of thermally formed nitrogen oxides are disclosed in U.S. Pat. Nos. 3,837,788; 3,955,909; and 4,013,399.

It also has been suggested that the formation of nitrogen oxides might be avoided by careful mixing of the fuel and air. Thus, numerous methods have been proposed in attempts to obtain substantially uniform mixing during combustion of fuel and air without the formation of nitrogen oxides. For example, it has been suggested that the air and/or fuel be swirled about the combustion chamber or be injected tangentially and the like to achieve uniform mixing and avoid creation of any localized hot spots which could result in the thermal formation of nitrogen oxides. Typical examples of such techniques, in some instances also utilizing temperature control, are found in U.S. Pat. Nos. 3,820,320; 3,826,077; 3,826,079; 4,007,001; and 4,054,028. However, perfect mixing, particularly of air with solid or liquid fuels, while a desirable goal, is difficult if not impossible to achieve. The solid or liquid fuel must first be gasified in order to mix and react with the combustion air. Since the solid or liquid fuel has not begun to gasify or vaporize on first contact with the combustion air, the air/gaseous fuel ratio initially begins at an infinite ratio and decreases to the overall air-fuel ratio as gasification or vaporization proceeds, thereby inevitably creating so-called hot spots. Thus, none of the techniques which rely on uniform mixing have been completely successful in the elimination of nitrogen oxides from the combustion products.

Other patents relating to combinations of temperature control and mixing, with combustion air being introduced in multiple stages, are U.S. Pat. Nos. 4,060,376 and 4,060,378. These patents suggest that the formation of thermal $NO_x$ can be avoided by maintaining the temperature below about 1400° C.; however, it must be appreciated that when withdrawing sufficient heat to maintain the temperature at such low levels, the efficiency of the combustor and the heat transfer coefficients through, for example, a boiler water tube are adversely affected. In addition, emissions of carbon monoxide and unburned carbon and other fuel fragments may also be high.

It also has been suggested in U.S. Pat. No. 4,144,017 that a combination of temperature control and control of the fuel-air ratio for burning the fuel in serially connected furnaces can be an effective means of inhibiting the formation of $NO_x$. However, this patent, like many of the others, relies upon uniform mixing to avoid forming localized hot spots which result in production of thermal $NO_x$.

It also has been suggested that certain additives may be introduced into the combustion zone. These additives will decompose in the combustion environment to form reducing materials which will react with and reduce the nitrogen oxides to form nitrogen. The suggested additives include the formates and oxalates of, among others, iron, magnesium, calcium, manganese, and zinc. One obvious disadvantage to this additive process, in addition to the complexity involved, would be the cost of the suggested additives which must be injected into the combustion zone. The reduction of nitric oxide by carbon monoxide over a catalyst consisting of various metal oxides also is known.

It must be appreciated that none of the heretofore discussed methods for reducing the formation of nitrogen oxides specifically addresses reducing the formation of nitrogen oxides from the fuel-bound nitrogen, Rather they are principally directed toward preventing the formation of the thermally formed nitrogen oxides. A need still exists for a method and apparatus for the combustion of fuel which could substantially eliminate nitrogen oxides derived from either source (thermal or fuel-bound) in the combustion products, and which would not rely on achieving perfect uniformity of mixing of fuel and air nor require the injection of expensive additives into the combustion zone nor involve subsequent scrubbing of the combustion products with absorbents.

SUMMARY OF THE INVENTION

The present invention provides a method of utilizing one or more zones for the combustion of fuels whereby minimal quantities of $NO_x$ are present in the resulting combustion products. Practice of the present invention effectively controls emission of both thermally formed nitrogen oxides as well as nitrogen oxides formed from the nitrogen compounds contained in the fuel and which are released during combustion.

A key feature of the invention is the manner in which $NO_x$ control is achieved utilizing one or more combustion zones. In contrast to other approaches to $NO_x$ control which attempt to prevent, inhibit, or avoid the formation of $NO_x$, principally by maintaining relatively low combustion temperatures, in the present invention the formation of significant amounts of nitrogenous compounds, such as $NO_x$, $NH_3$ and HCN, is accepted. However, by establishing and maintaining certain parameters of air-fuel stoichiometry and high temperature, any significant quantities of $NO_x$ (and other undesired nitrogenous compounds) formed during initial combustion are in superequilibrium, i.e., above the low $NO_x$ equilibrium concentrations for these parameters; and those reactions which lead to reduction of $NO_x$ proceed at a much faster rate than those which lead to its formation. Therefore, the net reaction results in $NO_x$ decomposition or destruction, which is directed toward reducing the concentrations of the $NO_x$ compounds to equilibrium concentrations. Thus, by operating in a specified band of fuel-rich stoichiometry and maintaining a desired high temperature of at least 1800° K. for a sufficient length of time in a first combustion zone, which functions as a nitrogenous compound decomposition zone, the $NO_x$ content of the combustion products (as well as that of $NH_3$ and HCN present) can theoretically be reduced essentially to zero. Combustion of the fuel may be completed in one or more subsequent zones, or the combustion gases of reduced $NO_x$ content discharged from this nitrogenous compound decomposition zone may be used directly for other applications.

The present invention is based on a recognition that achieving thorough and instantaneous mixing of the combustion air with the fuel (particularly with solid or liquid fuels) is essentially impossible, and localized regions of high temperature resulting in high $NO_x$ formation rates will occur. Thus an initial high level of $NO_x$ is expected to be present in the combustion zone. In accordance with the present invention, specific combustion stoichiometry, residence or stay times, and high temperatures well above those heretofore thought suitable for obtaining low $NO_x$ emissions are subsequently utilized not only to prevent further $NO_x$ formation but to bring about the decomposition or destruction of that $NO_x$ already formed in the initial stages of combustion.

In accordance with the present invention, a combustible fuel and an oxygen-containing gas, suitably and preferably air, are introduced into the first combustion zone, the air being introduced in an amount to provide from about 45% to 75% and preferably about 50% to 65% of the oxygen requirements for complete combustion of the fuel; the combustible fuel-air mixture reacts to form combustion products including nitrogenous compounds; and the resultant mixture of fuel and combustion products is maintained at a temperature of at least 1800° K. and preferably from about 1850° to 2500° K. for a time sufficient to reduce the concentration of the nitrogenous compounds a desired amount, to form primarily elemental gaseous nitrogen. Temperatures between about 2000° and 2500° K. are particularly suitable and preferred.

For most applications, complete combustion of the fuel to obtain maximum heat is desired. In such instances, the mixture of fuel and combustion products discharged from the first combustion zone is passed into one or more subsequent combustion zones during which time the temperature is such subsequent zones preferably is maintained within a range of from about 1600° to 2000° K. while sufficient additional air is introduced to provide from 100% to about 120% of the total stoichiometric amount required for complete combustion of the fuel.

It also has been found that certain materials may be added to the first combustion zone in particulate form which will substantially accelerate the decomposition rate of the $NO_x$ and other nitrogenous compounds to produce molecular nitrogen. It is a particular advantage of the present invention that many of these additive materials occur naturally in the fuels as their ash constituents.

PREFERRED EMBODIMENT

The present invention in its broadest aspects provides a method for the partial or complete oxidation of a combustible fuel in one or more combustion zones with minimal or substantially reduced emission of nitrogenous compounds which normally are formed during combustion. In contrast to the methods and apparatus known heretofore, the present invention does not require uniform mixing during the initial combustion stage to prevent the formation of oxides of nitrogen. Further, it is not necessary to maintain a low temperature during this initial combustion stage. Indeed, in accordance with the present invention, high temperatures which result in the initial formation of significant amounts of nitrogenous compounds are preferred for the initial combustion zone.

Figure 1:
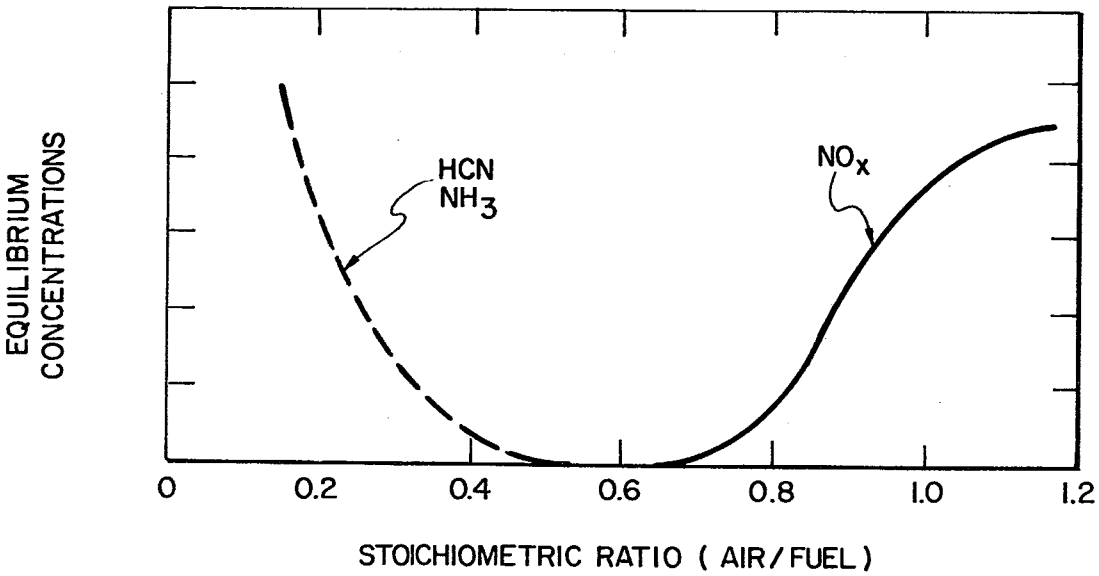
FIG. 1 is a graph depicting the equilibrium concentrations of several major nitrogenous compounds vs. the air/fuel stoichiometry.

The present invention will now be particularly described with respect to its preferred aspects involving the complete oxidation of a fuel such as coal in a plurality of zones with substantially reduced emission of oxides of nitrogen. Referring to FIG. 1, therein is depicted a graph showing the equilibrium concentrations of several major nitrogenous compounds ordinarily formed during combustion vs. air/fuel stoichiometry. Within a certain narrow band of stoichiometry, any significant concentrations of these nitrogenous compounds which are present exist in a state of superequilibrium. Specifically, in accordance with the present invention, a combustible fuel and an oxidizing gas such as air are introduced, generally at atmospheric pressure, into a first combustion zone, the combustion air being introduced in an amount to provide from about 45% to 75% of the stoichiometric amount required for complete oxidization of the fuel, and preferably in an amount of from 50% to 65% of the total required. The fuel-air mixture reacts, and the combustion products containing $NO_x$ and other nitrogenous compounds are maintained at a temperature of at least 1800° K. for a time sufficent to permit the concentration of the nitrogenous compounds to be lowered to the desired low equilibrium levels for these compounds. Referring again to FIG. 1, it will be seen that it is possible to achieve substantially complete reduction of all the nitrogenous compounds to elemental nitrogen; however, in many instances, such complete reduction may not be required or desirable. Since the low concentration level achieved is, among other things, a function of temperature and stay or residence time, in the interest of minimizing the length of the combustion zone required to achieve such residence time or avoiding the necessity of using excessively high temperatures, it may be desirable to allow some residual nitrogen compounds to remain.

Figure 2:
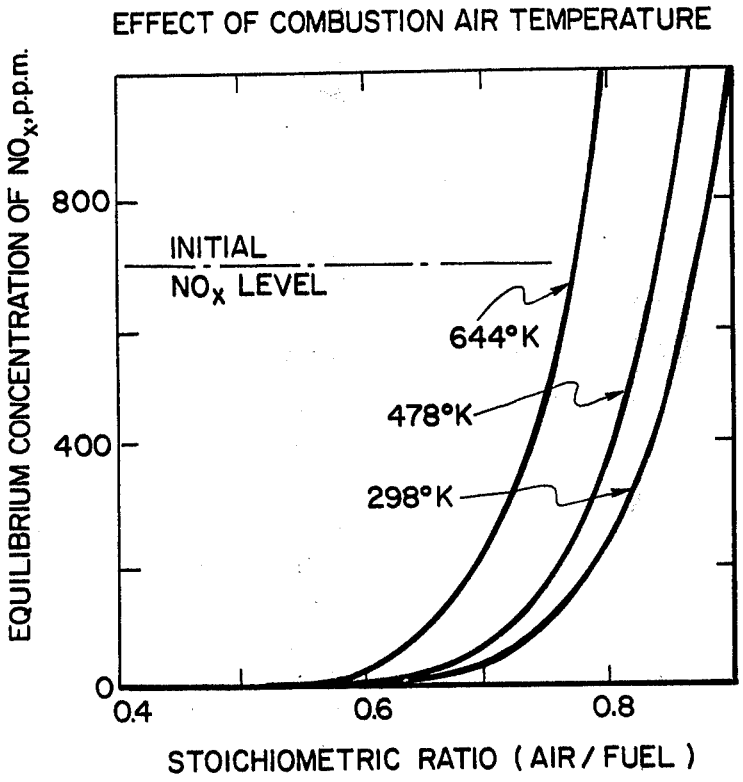
FIG. 2 is a graph depicting equilibrium $NO_x$ concentration vs. air/fuel stoichiometry for different combustion air temperatures.

In FIG. 2 is shown a graph depicting equilibrium $NO_x$ concentration vs. the air/fuel stoichiometric ratio for three different combustion air temperatures. As may be noted, high $NO_x$ levels may be formed in the initial phase of combustion because not all of the fuel will have been gasified and/or mixed with the air, and the air/gaseous fuel ratio and $NO_x$ equilibrium levels will be high. $NO_x$ may be formed in this initial combustion phase by the thermal mechanism but most particularly from conversion of fuel-bound nitrogen. However, when the desired fuel-rich stoichiometric ratio is established, the equilibrium concentrations of the $NO_x$ attain very low values for this desired stoichiometric ratio. By maintaining a temperature of at least 1800° K. at the desired stoichiometric ratio, $NO_x$ decomposition or destruction rapidly occurs, these $NO_x$ decomposition reactions being directed toward reducing the superequilibrium concentration of the $NO_x$ compounds to their low-equilibrium concentrations at the desired stoichiometric ratio. At these low-equilibrium concentrations, differences in the combustion air temperature are seen to have little significant effect on the $NO_x$ concentration.

The influences of stoichiometry, combustion temperature, and pressure in the practice of the present invention are reflected in the stay or residence time required to rapidly reduce nitrogenous compounds, formed in the initial combustion, and in the low minimum achievable $NO_x$ equilibrium concentration level. During the initial combustion reactions there occurs a complex combination of gasification, mixing, combustion under wide ranges of stoichiometry, recirculation, and formation of $NO_x$ from both conversion of fuel-bound nitrogen and from the thermal mechanism. Thus, the initial $NO_x$ levels cannot be predicted from first principles but must depend on experiment. In general, for coal fuels, these initial $NO_x$ levels appear to be only slightly lower than those measured in coal combustion when no efforts are made to control $NO_x$ emissions, i.e., about 500–700 ppm. The time required for initial combustion is not considered part of the stay time required for $NO_x$ destruction and, in fact, this initial combustion may be carried out in an earlier combustion zone or stage. It may also be associated in certain instances with an earlier sulfur oxide removal stage. The time required to complete the desired $NO_x$ destruction, then, is determined by the given initial $NO_x$ level, the final desired level, and the average rate of $NO_x$ destruction between these levels.

In general, the rate of destruction of superequilibrium $NO_x$ can be modeled as a function of the net rate of the individual chemical reactions involved and of the difference between the actual and the equilibrium $NO_x$ levels under the established conditions of stoichiometry and high temperature. The limited range of fuel-rich stoichiometry is established to provide very low equilibrium $NO_x$ levels. This not only provides the maximum difference between actual and equilibrium levels, to maximize the destruction rate, but provides low minimum achievable $NO_x$ levels as well.

The effect of temperature on the destruction rate is primarily through the very strong, exponential effect on the rates of the chemical reactions involved, but temperature also has a relatively strong effect on equilibrium $NO_x$ levels as well. With the very low equilibrium $NO_x$ levels established by the specified fuel-rich stoichiometry, however, even temperature changes of several hundred degrees Kelvin, though the effect might be to double or triple the equilibrium concentration, still result in changes in the equilibrium level which are small compared to the difference between the average actual levels and the equilibrium levels and very small compared to the strong, exponential effect on the chemical reaction rates involved.

The foregoing effects are illustrated in FIG. 2, which shows the effect of stoichiometry or equilibrium $NO_x$ concentrations for different combustion air temperatures. This illustrates the exemplary case for a heavy crude oil burned with air preheated to various temperatures. In the stoichiometric range of interest, the variations in the resulting combustion temperatures are about 90 percent of the variations in the combustion air temperature. At a stoichiometric ratio of 0.8, FIG. 2 shows that increasing the combustion air temperature from ambient (298° K.) to 644° K. (700° F.), an increase of 346° K., increases the equilibrium $NO_x$ level from 230 ppm to over 1000 ppm. Clearly, in this stoichiometric range, from the standpoint of $NO_x$ control, combustion temperatures should be as low as feasible. It is this kind of reasoning which has led much of the prior art relating to $NO_x$ control to evolve various techniques to minimize the initial combustion temperature and to reduce it further as quickly as possible. The general basis for this reasoning is the prior art assumption that optimum $NO_x$ control is achieved by preventing or inhibiting $NO_x$ formation. Under this assumption, $NO_x$ formation must be controlled; thereby it is hoped to be able to obtain $NO_x$ concentration levels below equilibrium. To accomplish this, low combustion temperatures are required, as is shown in the prior $NO_x$ control art.

A feature of this invention, however, is the observation and recognition that it is essentially impossible to prevent formation of undesirably high levels of $NO_x$ in the initial combustion, and these high $NO_x$ levels will exist. Thus, low combustion temperatures are not used herein to attempt to prevent the formation of these high initial $NO_x$ concentrations. Further, low combustion temperatures are not used to attempt to obtain low $NO_x$ equilibrium levels. In accordance with the present invention for achieving very low levels of $NO_x$ emissions, this initial high amount of $NO_x$ formed must be substantially destroyed. To accomplish this, high combustion temperatures and specific air/fuel stoichiometry are utilized to accelerate this destruction. These specific combustion stoichiometry conditions must be established, however, for this $NO_x$ destruction region so that the high combustion temperatures utilized do not also result in high equilibrium $NO_x$ levels. FIG. 2 shows that, with stoichimetric ratios less than about 0.6, the equilibrium $NO_x$ levels are so low that the effects of high combustion air temperatures still result in very low equilibrium $NO_x$ levels. For example, at a stoichiometric ratio of 0.55, the $NO_x$ equilibrium levels are less than 10 ppm regardless of the preheat and combustion temperatures. Therefore, an increase of 346° K. in the air preheat temperature (about 310° K. increase in the combustion temperature) results in a change in the equilibrium $NO_x$ level of less than 10 ppm, which is small compared to a possible initial $NO_x$ level of 500–700 ppm.

Thus, over most of the period of $NO_x$ destruction, in the selected range of stoichiometry, the difference between the actual and equilibrium $NO_x$ levels can be considered essentially independent of the combustion temperature. The remaining effect of temperature, then, is the very strong, exponential increase in $NO_x$ destruction rates with increasing temperature through the temperature effect on the chemical reaction rates involved. In accordance with the present invention, then, maximum combustion temperatures are desired to maximize the rate of destruction of the initial $NO_x$ which, in turn, shortens the required stay time under these conditions and provides a short, compact, and practical burner or combustor. If extremely low $NO_x$ emissions are desired, such that the actual $NO_x$ levels begin to approach equilibrium at these high temperatures, the gases can be cooled subsequently to not less than 1800° K. to achieve further $NO_x$ reduction by further lowering the equilibrium level.

As above noted, the stay or residence time required to complete $NO_x$ destruction to the desired equilibrium level is inversely and exponentially related to the temperature that is maintained in the nitrogenous compound decomposition zone, as well as a function of the fuel-rich stoichiometric ratio that is present, the initial $NO_x$ concentration levels established, and the final $NO_x$ equilibrium concentration levels desired, together with the physical configuration of the decomposition zone. Thus, for some applications and reaction condition parameters, residence times as low as 5–10 msec may be sufficient; whereas, for other applications, residence times as high as 5–10 sec may be required. Thus, for temperatures in the first reaction zone between about 1850° and 2500° K., residence times between 10 and 200 msec are ordinarily used. In general, for typical reaction conditions in the decomposition zone of about 2000° K., a stoichiometric air/fuel ratio of about 0.6, an initial $NO_x$ concentration level of about 500 ppm, and a final concentration level of 30 ppm, residence times between 20 and 60 msec will usually be utilized.

The effect of pressure on the time required for $NO_x$ destruction has been shown, by equilibrium calculations and by combustor kinetic modeling, to be small. The controlling reactions in $NO_x$ equilibrium, in fuel-rich mixtures, are all equimolar, except for the dissociation reactions of the elemental gases. The degree of dissociation is reduced at higher pressures directly by the pressure effect, but this is nearly balanced by the slight increase in temperature that results from the higher pressure. Equilibrium calculations for Illinois No. 6 coal burned with 60% of stoichiometric air show that increasing the pressure by a factor of 6 decreases the equilibrium $NO_x$ by only a factor of 2. Since the controlling reactions involved in the $NO_x$ destruction rate are all equimolar, therefore, the destruction rate should not be significantly affected by pressure.

The predominant effect of pressure is in the zone of initial combustion and is on the rate of gasification of the solid or liquid fuel particles. The stay time for this process is inversely proportional to pressure. This effect of pressure is well known and is taken into account in pressure-scaling laws. Again, this initial gasification and combustion zone need not be a part of the $NO_x$ destruction zone and, in fact, may be carried out in an earlier combustion zone or stage. Because the stay time for gasification is shorter at higher pressures, higher pressures would appear preferred, and pressures up to 20 atm or higher may be used. However, the energy required to compress air for combustion at the higher pressures is often prohibitive, except in certain specially designed combustion systems. Therefore, atmospheric combustion is normally preferred. For a combined-cycle system in which a gas turbine cycle is followed by a Rankine cycle, higher pressures at about 6 atm will ordinarily be preferred.

The inventor does not know with certainty, and does not wish to be bound by any theoretical explanation of, the exact underlying mechanism involved in the reduction of the nitrogenous compounds in the practice of the present invention. However, the following explanation is offered as a possible mechanism, particularly with regard to the reduction of nitric oxide within the claimed stoichiometric range. The following exemplary equations are offered as possible reduction mechanisms:

| | Mechanism | Rate Constant at 2000° K. |
|---|---|---|
| I. | $NO + N \rightarrow N_2 + O$ | $2 \times 10^{13}$ |
| II. | $NO + H \rightarrow N + OH$ | $5 \times 10^{8}$ |
| III. | $NO + O \rightarrow N + O_2$ | $2 \times 10^{8}$ |

The foregoing reactions will be recognized as the Zeldovich mechanisms for thermal $NO_x$, as modified to better describe $NO_x$ reactions in a fuel-rich environment.

From the foregoing equations, it is seen that Reaction I is very fast but limited by the availability of N which can be supplied only from the reactions set forth in Reactions II and III. However, it also will be appreciated that the hydrogen concentration during the combustion of a fuel, under fuel-rich conditions, will normally be in the order of two to three magnitudes greater than that of oxygen at, for example, a temperature of about 2000° K. Thus, reduction of nitric oxide by Reaction II should be from about six to seven times faster than that by Reaction III. Accordingly, the rate-controlling reaction in the destruction of nitric oxide presumably would be that exemplified by Reaction II.

Experimental observations have indicated that significant reduction of nitrogen oxides does not occur except within the previously taught stoichiometric ratios wherein significant nitric oxide concentrations are in superequilibrium. It further has been observed that the nitric oxide reduction rate is faster when hydrogen concentrations are high. In addition, it has been observed that the nitric oxide reduction rate is faster at higher temperatures. Also, based on the foregoing reactions taking place, the reduction rate of nitrogen oxides should be faster when the OH and oxygen concentrations are low in order to limit the rate of a reverse reaction.

In addition to the oxides of nitrogen formed during the initial combustion in oxygen-rich high-temperature zones (thermal nitrogen compounds) and from conversion of fuel-bound nitrogen to $NO_x$, there may be formed compounds such as HCN. The probable mechanism for a reduction of this compound is set forth in the following reactions:

| | Mechanism | Rate Constant at 2000° K. |
|---|---|---|
| IV. | $HCN + OH \rightarrow CN + H_2O$ | $5 \times 10^{12}$ |
| V. | $CN + O \rightarrow CO + N$ | $1 \times 10^{12}$ |

It is seen that the foregoing theoretical reduction mechanisms are extremely rapid, and, in addition, form carbon monoxide and N, the latter of which is an essential element to the theoretical destruction mechanism set forth in Reaction I for nitrogen oxides. Further, the carbon monoxide formed will react with any OH radicals in accordance with the following reaction:

$$CO + OH \rightarrow CO_2 + H$$

This reaction also is very rapid and removes OH radicals which could permit a reversal of the desired $NO_x$ reduction (Reaction II) and also generates H atoms which accelerate nitrogen oxide reduction by Reaction II. Indeed, it has been observed that the rate of reduction of nitrogen oxides is enhanced by high carbon monoxide concentrations.

In addition to the foregoing possible reactions, it also has been observed that certain solids further enhance the nitrogen oxide reduction rate. Specifically, carbonaceous materials such as soot, char, and coke enhance the reduction rate. Ceramic or inert refractory materials are reported as having a similar effect. The precise mechanism is not known; thus, these materials may act as catalysts or in some unknown way participate in the reaction or in an intermediate reaction. In addition to the foregoing compounds, others which have been observed to enhance the reduction of nitrogen oxides are iron compounds, such as iron sulfides and iron oxides; the calcium compounds, such as calcium sulfide and calcium oxide; and various combinations of these materials. In particular, the iron compounds, such as iron sulfide, and petroleum coke have been observed to greatly enhance the reduction of the nirogen compounds to elemental nitrogen within the claimed stoichiometry and temperature conditions described herein. Thus, when it is desired to minimize the length of the combustion zone and still obtain a desired amount of nitrogen compound reduction within a specified stay time, the addition of any one or more of the foregoing materials advantageously is employed. The particularly preferred additives are coke and the iron compounds, in view of their greater enhancement of the reduction rate of the nitrogen compounds, and soot and coal fly ash because of their presence in many fuel combustion products. In addition to the foregoing compounds, numerous other materials are known in the art which is recognized catalysts for nitrogen compound reactions, and it would be anticipated that any such catalytic material could advantageously be employed in accordance with the present invention.

Figure 3:
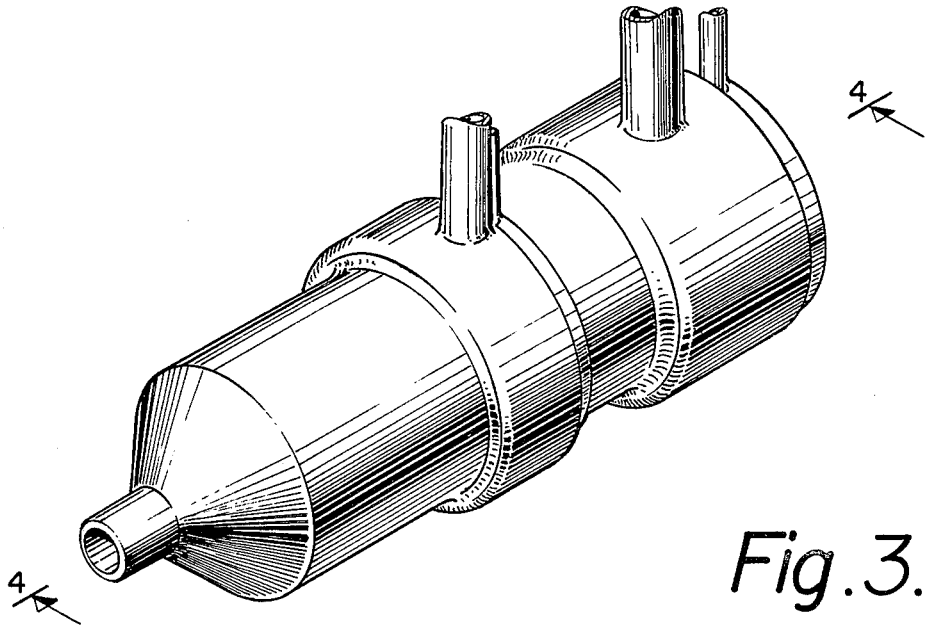
FIG. 3 is a perspective view of a two-zone burner utilized for practice of this invention.
Figure 4:
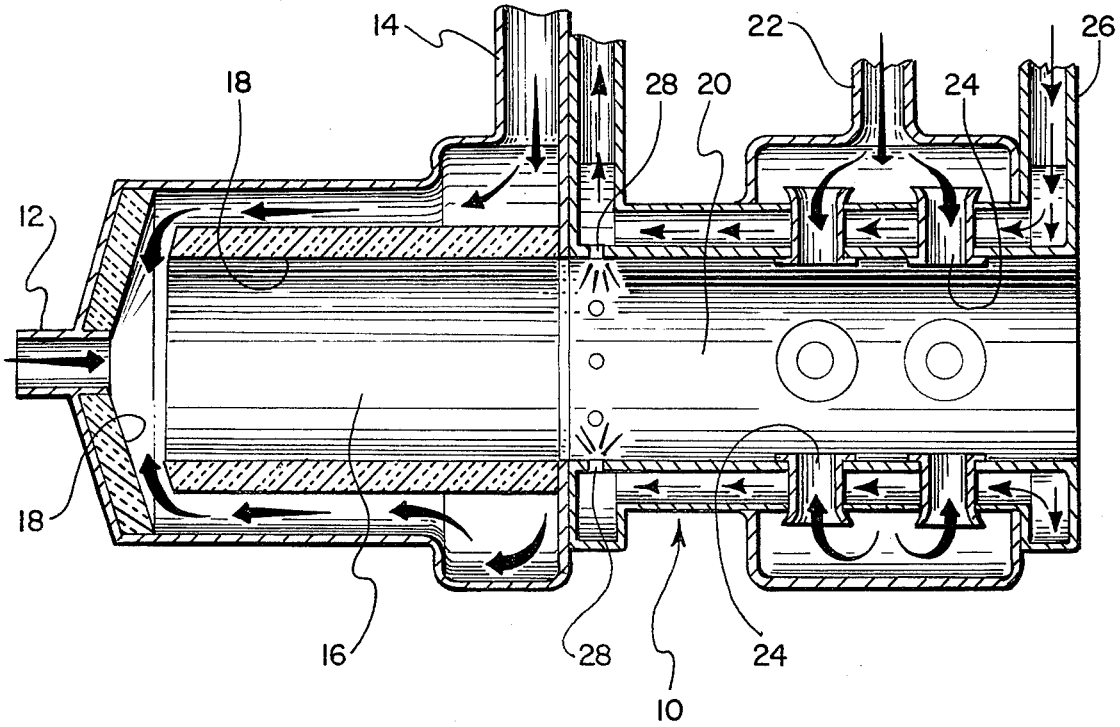
FIG. 4 is a schematic view in cross section taken along the lines 4—4 of FIG. 3.

Referring now to FIG. 3, an overall perspective view of a burner assembly for practicing the present invention is shown. A cross-sectional view of this burner assembly 10 is shown in FIG. 4. The term "burner" or "burner assembly" is used herein to refer to a device which brings together fuel and air, mixes these to form a combustible mixture, and partially completes the combustion to achieve the desired composition of combustion products. Although general usage is not consistent, the term "burner" is generally considered to refer primarily to that part of a combustion device which brings together fuel and air and prepares the mixture for combustion (for example, a Bunsen burner), while the term "combustor" is generally considered to refer to the burner plus that part of the device within which combustion is completed (for example, a gas turbine combustor). Such terms as "furnace" and "boiler" are generally considered to include not only the combustor but also various end uses of the heat of combustion, none of which are considered to be specific features of this invention.

This invention is concerned with controlling combustion, to the degree necessary to achieve low $NO_x$ emissions, in a wide variety of applications. In no application is it necessary to contain combustion within the device constructed to achieve this purpose until combustion has been completed, i.e., until all chemical species have been converted to the lowest energy state. In some applications, the desired combustion products may actually be the fuel-rich gases resulting from partial combustion. For these reasons, and because the unique apparatus developed to practice the present combustion process is intended to replace devices generally referred to as burners, the term "burner" as applied herein should be construed broadly in reference to such apparatus.

Referring again to FIG. 4, fuel is introduced into burner assembly 10 through an inlet 12. The present invention is applicable to a wide variety of combustible fuels which contain fuel-bound nitrogen, in addition to those which do not. Thus, the present invention is applicable to those substantially pure fuels such as methane, butane, propane, and the like, as well as various petroleum products, including gasoline, kerosene, fuel oils, diesel fuels, the so-called bunker fuel oils, as well as crude petroleum, petroleum residua, and various other petroleum byproducts which may contain various amounts of nitrogen. In addition, the present invention also is applicable to normally solid fuels, including asphalt, coal, coal tars, shale oil, lignite, wood, and even combustible municipal or organic waste. Such solid fuels, particularly coal, are ordinarily fed to the burner in dense-phase or dilute-phase feed using a carrier gas, generally air, although an inert gas such as nitrogen or recirculated flue gas may also be used. Any air present in the carrier gas will be included as part of the stoichiometric air requirements for combustion of the fuel. The exemplary apparatus shown in FIGS. 3 and 4 is considered appropriate for the combustion of a solid fuel such as coal.

Also introduced into burner assembly 10 via an inlet 14 is a source of oxygen such as air, pure elemental oxygen, oxygen-enriched air, or the like. Generally, air is preferred in the interest of economy. The air and fuel are mixed with one another and reacted in a first combustion zone 16. It is, of course, an essential element of the present invention that the air and fuel be introduced in amounts to provide from about 45% to 75% of the stoichiometric amount of air (including any carrier-gas air) required for complete oxidation of the fuel and, further, that the temperature of the combustion products formed therein be maintained at a temperature of at least 1800° K. for a time sufficient to obtain the desired reduction of nitrogenous compounds. Advantageously, the temperature in combustion zone 16 is maintained at least at about 2000° K. No particular upper limit to the temperature is present except that dictated by economics and materials of construction. Higher temperatures increase the rate of reduction and permit use of a shorter combustion zone to obtain the desired amount of reduction of nitrogenous compounds. However, the availability and cost of materials capable of withstanding such high temperatures can offset the benefits obtained therefrom. Accordingly, it generally is preferred to maintain the temperature between about 1850° and 2500° K., temperatures between about 2000° and 2500° K. being considered particularly suitable and preferred. Even within this temperature range, it may be necessary to provide protection to the walls of combustion zone 16 such as by inclusion of a ceramic coating or lining 18. Various inorganic ceramic refractory materials such as silicon, zircon, zirconia, magnesite, dolomite, alumina, and silicon carbide are suitable.

In accordance with a particularly preferred embodiment, the air introduced through inlet 14 preferably is preheated to a temperature of from about 500° to 800° K. to maintain the desired temperature in combustion zone 16. This preheated air is passed in heat-exchanging relationship with combustion zone 16 prior to entering zone 16. Thereby, this preheated air also serves to insulate the outer surfaces of burner assembly 10 from the high temperatures present in zone 16. However, numerous equivalent methods for providing heat to zone 16 will be readily apparent to those versed in the art. For purposes of economy, many combustion devices, such as boilers, normally preheat the combustion air by heat exchange with the flue gases leaving the device. Alternatively, electrical heating elements or other types of indirect heat exchange could be utilized to maintain the desired temperature.

The combustion products leave combustion zone 16 and enter at least a second combustion zone 20. In combustion zone 20, additional combustion air is supplied through an inlet 22. This combustion air enters combustion zone 20 through one or more conduits 24. An essential feature of the temperature regimen for this combustion zone 20 is that the temperature be maintained below that at which substantial amounts of thermal $NO_x$ will be formed. However, this aspect of secondary combustion is known to those versed in the art. Thus, by maintaining the temperature below about 2000° K., and preferably within a range of from about 1600° to 2000° K., substantially complete combustion of the fuel is obtained in one or more stages without the formation of any additional nitrogenous compounds.

When high temperatures are used in the first combustion zone, it may be necessary to cool the combustion products leaving this first combustion zone prior to the introduction of the additional combustion air in the subsequent combustion zones. This may be accomplished in various manners known to those versed in the art. For example, the gases may be cooled by passing them in indirect heat-exchange relationship with a cooling fluid introduced through an inlet 26 of burner assembly 10. In addition or alternatively thereto, a coolant fluid can be introduced directly into the hot gases via nozzles 28. Still further, the combustion air introduced through inlet 22 can be cooled and diluted with an inert gas such as recirculated flue gas to absorb heat or the like. These and numerous other techniques will be readily apparent to those versed in the art.

Once the hot gaseous combustion products leave the burner and the desired amount of thermal energy has subsequently been extracted from these combustion products, the gases are readily dischargeable to the atmosphere with little or no pollutant effect. Specifically, in accordance with the present invention, it is possible to burn substantially any combustible fuel, generally fossil fuels, and discharge a product or waste gas containing less than 50 ppm oxides of nitrogen. It is a particular advantage of the present invention that it provides a relatively compact burner assembly which is suitable as a retrofit for a utility boiler application and other existing facilities wherein fuels are burned for the principal purpose of producing heat.

The following examples will serve to further illustrate the advantages and application of the present invention, but should not be construed as limiting its scope.

EXAMPLE 1

This example demonstrates the application of the present invention to the combustion of coal. Specifically, a quantity of Illinois No. 6 coal was obtained, which had the following composition:

ULTIMATE ANALYSIS (Dry Basis, Wt %)

Carbon: 72.75
Hydrogen: 4.83
Nitrogen: 1.18
Chlorine: 0.40
Sulfur: 1.85
Ash: 9.74
Oxygen (Diff.): 9.26

The coal was introduced into a burner combustion zone similar to that depicted in FIG. 4. The coal was introduced at a rate of about 0.16 kg/sec (0.35 lb/sec). Preheated air at a temperature of approximately 616° K. (650° F.) also was introduced into the combustion zone at a rate of 0.73 kg/sec (1.6 lb/sec) to provide approximately 51% of the total stoichiometric amount of air required for complete combustion of the coal. In this example, although not a requirement of the invention, the pressure at which the coal was partially burned was about 5.8 atm. The combustion produce was maintained at about 1811° K. (2800° F.). Gas samples were taken from the combustion zone adjacent to the point of introduction of the fuel and air and also at a point approximately 1.8 m (6 ft) downstream therefrom. The samples were analyzed for $NO_x$, and the average values at the point of introduction and 1.8 m (6 ft) downstream were 690 and 44 ppm, respectively.

Thus, it is seen that within the presently claimed conditions, a substantial reduction in the nitrogen oxide content takes place. Indeed, in a time of about 40 msec, approximately 94% of the nitrogen oxide formed in the initial combustion was reduced to molecular nitrogen. Further, it will be appreciated that under further optimized conditions, substantially complete reduction of all the nitrogen oxides would be possible. However, even according to this one example, it is seen that the average nitrogen oxide content was only about 44 ppm. Following dilution with the additional combustion air, the effluent gases would be expected to have a nitrogen oxide content of less than 25 ppm, substantially below the maximum permissible nitrogen oxide emission requirements for most known applications. Thus, this example clearly demonstrates the utility of the present invention.

EXAMPLE 2

A series of screening tests were performed to determine the effect of additives on the reduction of nitrogen oxides in accordance with the present invention. A laboratory-scale burner was set up in which natural gas and air were partially combusted using between about 45 and 75% of the stoichiometric air required for complete combustion. Nitric oxide was added to the air-fuel mixture. Various particulate additives were introduced into the hot combustion products immediately downstream of the combustion zone. The nitrogen oxide content was measured immediately adjacent the flame front and downstream of the point of particulate injection. From these tests, it was demonstrated that the ash constituents of the Illinois No. 6 coal showed a substantial reduction in the nitrogen oxide content, even though the temperature was not sufficiently high that any substantial reduction would be expected. Calcium oxide also was tested and found to reduce the nitrogen oxide content within the claimed range of stoichiometry and temperature. The most significant reduction in nitrogen oxide content was noted using iron sulfide and petroleum coke particles. Accordingly, the iron compounds and particularly iron sulfide, whether artifically produced or naturally occurring, such as iron pyrite, and carbonaceous materials such as coke, are preferred additives for use in accordance with the present invention.

The foregoing description and examples illustrate a specific embodiment of the invention and what is now considered to be the best mode of practicing it. Those skilled in the art, however, will understand that changes may be made in the form of the invention without departing from its generally broad scope. Specifically, while the invention has been described, among other things, with respect to a certain preferred embodiment utilizing two combustion zones, it will be readily apparent that multiple combustion zones could be utilized. In some instances, it may be desirable to partially combust the fuel in a first reaction zone utilizing a lesser stoichiometry than that within the present claims, prior to utilizing the stoichiometry and temperatures of the presently claimed invention. In addition, the final combustion can be effected in a single second zone as herein described. Alternatively, of course, the final combustion air may be added in multiple zones. Indeed, it is within the scope of the present invention that the final combustion zone could be, for example, the fire box of a boiler wherein heat is drawn off by the boiler tubes during the addition of the final combustion air. In addition, it is within the scope of the present invention to provide other additives to the combustion zones shown or to preceding combustion zones for the removal of other pollutants such as sulfur compounds, chlorine, or the like if present and such removal is desired. These and numerous other variations will be readily apparent to those versed in the art. Accordingly, it should be understood that within the scope of the appended claims, the invention may be practiced otherwise than as specifically illustrated and described.

What is claimed is:

1. In a method for substantially reducing emission of nitrogenous compounds formed during fuel combustion wherein a combustible fuel is at least partially combusted with oxygen, nitrogenous compounds being formed during the initial combustion of the fuel, the improvement comprising:

providing a nitrogenous compound decomposition zone;

introducing said fuel and an oxygen-containing gas into said zone to form a combustible mixture, the gas being introduced in an amount to provide from about 45% to 75% of the total stoichiometric amount of oxygen required for complete combustion of the fuel;

reacting said combustible mixture to form combustion products including nitrogenous compounds;

providing finely dispersed particulates in said nitrogenous compound decomposition zone which enhance the conversion of the nitrogenous compound to molecular nitrogen, said particulates being selected from the group consisting of the sulfides and oxides of iron and calcium and combinations of these materials;

maintaining the resultant mixture of fuel, particulates, and combustion products at a temperature of at least 1800° K. for a time sufficient to reduce the nitrogenous compound content of said mixture to a desired level; and discharging said mixture having a substantially reduced nitrogenous compound content.

2. The method of claim 1 wherein said temperature is maintained within the range of from about 1850° to 2500° K.

3. The method of claim 1 wherein said oxygen is introduced in an amount to provide from about 50% to 65% of said total stoichiometric amount.

4. The method of claim 1 wherein said temperature is maintained by preheating said oxygen-containing gas.

5. A method for substantially reducing emissions of nitrogen oxides formed when burning a fuel comprising:

providing at least first and second combustion zones;

introducing the fuel into said first combustion zone;

introducing combustion air into said first combustion zone and mixing it with the fuel to react therewith to form combustion products including nitrogen oxides, said air being introduced in an amount to provide from about 45% to 75% of the total stoichiometric amount of air required for complete conbustion of the fuel;

providing finely dispersed particulates in said first reaction zone which enhance the conversion of any nitrogen compounds contained therein to molecular nitrogen, said particulates being selected from the group consisting of the sulfides and oxides of iron and calcium and combinations of these materials;

maintaining the resultant mixture of fuel, particulates, and combustion products at a temperature of at least 1800° K. for a time sufficient to reduce the nitrogen oxide content to a desired level;

passing said mixture into at least a second combustion zone; and maintaining said mixture at a temperature of less than about 2000° K. while completing the combustion by the introduction of additional air in an amount to provide from 100% to about 120% of the total stoichiometric requirements for complete combustion of the fuel.

6. The method of claim 5 wherein the temperature in said first combustion zone is maintained within a range of from about 1850° to 2500° K.

7. The method of claim 5 wherein said temperature is maintained in said first combustion zone by the introduction thereto of preheated air.

8. The method of claim 7 wherein said preheated air is first passed in indirect heat-exchange relationship with said first combustion zone prior to being introduced into said first zone.

9. The method of claim 5 wherein said temperature in said first combustion zone is at least at 2000° K. and the temperature in said second combustion zone is maintained within a range from about 1600° to 2000° K.

10. The method of claim 5 wherein the amount of air supplied to said first combustion zone is in an amount to provide from about 50% to 65% of the stoichiometric amount of air required for complete combustion of the fuel.

11. The method of claim 9 wherein said combustion products are cooled intermediate said first and second combustion zones.

12. The method of claim 5 wherein said combustion products in said first zone are maintained at a temperature of from aout 1850° to 2500° K. for a time between about 10 and 200 milliseconds.

13. The method of claim 5 wherein said fuel is a solid carbonaceous fuel injected as particulates and selected from the group consisting of coal, lignite, wood, coal tar, and petroleum byproducts which are solid at ambient temperatures.

14. The method of claim 5 wherein said fuel is selected from the group consisting of crude petroleum, petroleum residua, and petroleum byproducts and said fuel is injected as a liquid.

15. The method of claim 5 wherein said combustion products are maintained in said first combustion zone for a time sufficient that combustion products leaving said second combustion zone contain less than 50 parts per million of oxides of nitrogen.

16. The method of claim 1 wherein the combustible fuel is a fuel containing nitrogen compounds.

17. The method of claim 5 wherein the combustible fuel is a fuel containing nitrogen compounds.

* * * * *